United States Patent [19]

Gloeckler

[11] 4,030,319

[45] June 21, 1977

[54] DOMESTIC KNITTING MACHINE

[75] Inventor: Alfred Gloeckler, Mulhouse, France

[73] Assignee: Superba S.A., Mulhouse, France

[22] Filed: Apr. 23, 1976

[21] Appl. No.: 679,876

[30] Foreign Application Priority Data

Apr. 24, 1975 France ..... 75.13490

[52] U.S. Cl. ..... 66/75.2; 66/154 A

[51] Int. Cl.[2] ..... D04B 7/00; D04B 15/66

[58] Field of Search ..... 66/75.2, 154 A, 50, 66/60, 64

[56] References Cited

UNITED STATES PATENTS

| | | | |
|---|---|---|---|
| 3,262,285 | 7/1966 | Beguiw et al. | 66/50 R |
| 3,283,541 | 11/1966 | Decerjat | 66/50 R |
| 3,472,287 | 10/1969 | Ribler | 66/75 A UX |
| 3,518,845 | 7/1970 | Decerjat | 66/75 A |
| 3,605,448 | 9/1971 | Ribler | 66/154 A |
| 3,812,691 | 5/1974 | Engelfried | 66/50 R |

FOREIGN PATENTS OR APPLICATIONS

| | | | |
|---|---|---|---|
| 47-35337 | 9/1972 | Japan | 66/75 R |
| 883,432 | 11/1961 | United Kingdom | 66/50 R |

*Primary Examiner*—Ronald Feldbaum
*Attorney, Agent, or Firm*—Mason, Fenwick & Lawrence

[57] ABSTRACT

This invention is relative at domestic knitting machine consisting of at least one needle board supporting slidingly in grooves the knitting needles and a movable carriage parallel above the needle board, the carriage being provided with a lock fitted with an electromagnetic needle selection component, which machine is characterized in that the electromagnetic component is mounted on the lock with the aid of a guiding means ensuring free movement in a direction substantially perpendicular to the plane of the needle board.

8 Claims, 2 Drawing Figures

DOMESTIC KNITTING MACHINE

The invention relates to a domestic knitting machine.

Domestic knitting machine currently used today consist of one or two needle boards which are provided with parallel grooves in which the knitting needles are placed in a manner such that they can slide. Above these needle boards are placed carriages which can move longitudinally to the needle boards by means of slides so as to control the needles by means of their butt.

In order to control the needles, each carriage comprises cam paths, as well as at least one electromagnetic component which does or does not deflect the butts of the needles in order to bring them to such or another cam path according to whether the electromagnetic component is live or not when it passes in front of a particular knitting needle.

The impulses brought to the electromagnetic component in accordance with its movement in front of the needle board to control the needles are produced by programming components of which several modes of construction are known.

However, it appeared that faults could arise in the selection of the needles by the electromagnetic component, these selection mistakes occurring in particular for mechanical reasons.

Thus, it can happen that one of the grooves of the needle board receiving slidingly one of the needles has a depth which is different from that of the other needles or contains some foreign matter so that the height of the butt of this needle is located at a level different from that of the others with respect to the active parts of the electromagnetic component.

The result will be a selection error, which will cause prejudice to the quality of the knitwear that is made.

It is also possible that the needle butts themselves vary slightly in form or size from one needle to the other, so that they are not all in the best position with respect to the active parts of the electromagnetic component in order to be selected reliably.

The particular object of the present invention is to overcome these disadvantages and, to this end, relates to a domestic knitting machine consisting of at least one needle board supporting slidingly in grooves the knitting needles and a movable carriage parallel above the needle board, this carriage being provided with a lock fitted with an electromagnetic needle selection component, which machine is characterized in that the electromagnetic component is mounted on the lock with the aid of guiding means ensuring the free movement in a direction substantially perpendicular to the plane of the needle board.

According to another characteristic feature of the invention, the guiding means consist of at least one guiding rod perpendicular to the plane of the needle board and disposed laterally to the electromagnetic component.

According to another characteristic feature of the invention, the guiding means consist of at least one pivoting axle disposed parallel to the plane of the needle board and laterally to the electromagnetic component.

The invention is represented, by way of nonlimitative example, in the attached drawings, in which.

The object of the present invention is to provide a domestic knitting machine of which the carriage is provided with an electromagnetic needle selection component, this electromagnetic component being made in a manner such as to enable needle selection errors to be avoided.

Figure 1:
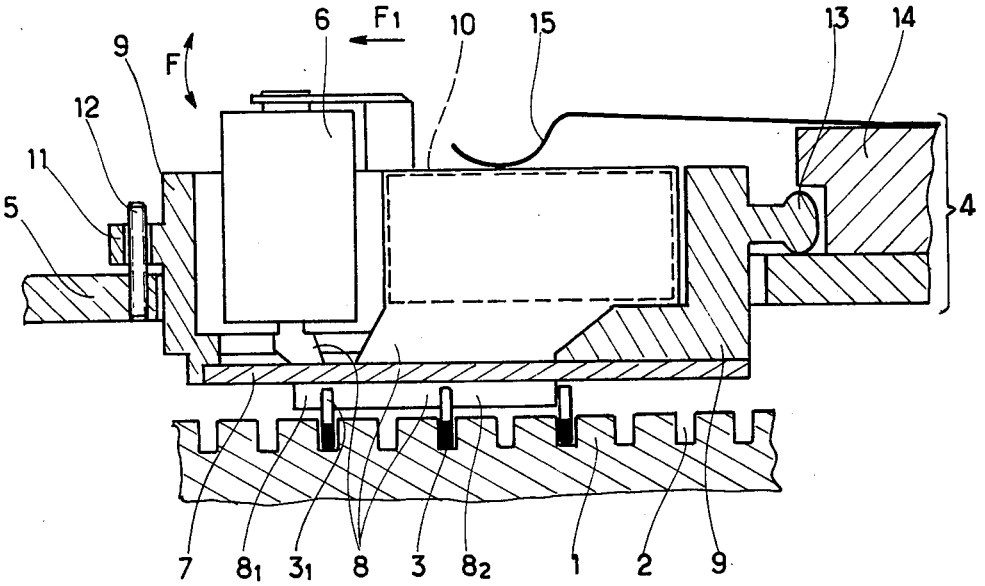
FIG. 1 is a partial longitudinal section of a domestic knitting machine.

FIG. 1 thus shows a knitting machine of which the needle board 1 is provided with grooves 2 receiving knitting needles 3 so that they can slide.

The needle board 1 is also provided, on its upper face, with slides (not shown) which receive the carriage 4 enabling the needles 3 to be selected during their to-and-fro movement above the needle board.

This carriage 4 is provided with cams (not shown) and an electromagnetic component 6 which selects the needles 3 by means of their butt $3_1$ in order to make them take one or other cam path according to the type of knitting to be effected.

However, according to the invention, this electromagnetic component 6 for the selection of needles is mounted on a lock 5 with the aid of guiding means which enable this electromagnetic component to move freely in a direction substantially perpendicular to the plane of the needle board and in a manner such that the polar pieces 7 and 8 of this electromagnetic component can adapt automatically as regards height in accordance with the level of each needle butt.

This arrangement then eliminates the necessity for any adjustment in view of the fact that the electromagnetic component positions itself automatically by compensating for the mechanical working tolerances which can exist between the position of the lock and the needles which slide in the grooves of the needle board allowing much higher knitting speeds to be attained.

In the example shown in FIG. 1, the electromagnetic component is made in the form of a unit consisting of a support piece, for example, made of plastic, which receives the electromagnetic component proper 6, a permanent magnet 10 and two polar masses 7 and 8.

In the example shown in this FIG. 1, the electromagnetic selection unit is provided, on one of its lateral edges, with at least one orifice 11 lodging, with slight play, on a guiding rod 12, which is integral with the lock 5.

On the other hand, on the lateral edge opposite the selection unit, the support 9 is provided with a border 13 extending perpendicular to the plane of the FIG. 1 and which constitutes an articulation axle for the selection component. To this end, the border 13 forming an articulation axle is maintained between the lock 5 and an upper part 14 in a manner such that the selection unit can pivot in the direction of the arrow F around this axle 13 being guided by the rod 12 in order to adapt itself, at any moment, to the level of the heels of the needles.

In the construction shown, the carriage moves during its active period in the direction of the arrow $F_1$, which is checked by the fact that the extremity $8_1$ of the polar piece 8 is subjected to the action of the electromagnetic 6 and is therefore located forward of the direction of the movement of the carriage with respect to the part $8_2$ which is subjected to the action of the permanent magnet 10.

But, according to the invention, provision is made to place the guiding rod 12, which is substantially perpendicular to the needle board 1, forward of the electromagnetic component with respect to the direction of the active movement (arrow $F_1$) whereas on the contrary, the articulation axle 13, which is disposed parallel to the needle board 1 and parallel to the grooves 2 and the needles 3, is disposed at the back of this electromagnetic component with respect to the direction of the active movement of the carriage.

This arrangement enables the forward part of the selection unit (left-hand side of the figure) to move sufficiently far so that the extremity $8_1$ which acts first electromagnetically on the butts of the needles can position itself suitably at any moment.

Likewise, as will be seen in FIG. 1, a blade of the spring 15, fixed on the part 14 of the lock, is disposed bearing on the selection unit in order constantly to tend to apply it onto the butt of the needle.

Figure 2:
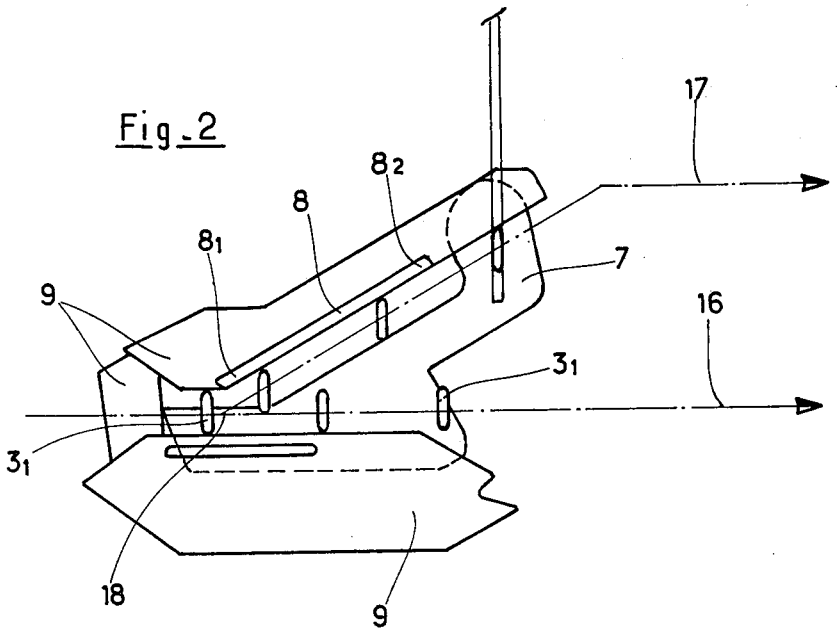
FIG. 2 is a view from below the active zone of the electromagnetic component shown in FIG. 1.

FIG. 2, which is a view from below the active zone of the selection unit, shows the two paths 16 and 17 which can be taken by the butts of the needles in order to position the needles 3 in a corresponding fashion depending on whether the electromagnet 6 of the electromagnetic component receives or does not receive a control impulse. Thus, when the electromagnetic 6 receives an impulse; it deflects the needle butts 18 towards the path 17, this deflection being then continued by the action of the rear part $8_2$ of the polar piece 8 which is submitted to the action of the permanent magnet 10.

Of course, the invention is not limited to the example of its embodiment hereinabove described and illustrated, and on the basis of which other modes and other forms of embodiment can be envisaged without departing from the scope of the invention.

What is claimed is:

1. A domestic knitting machine consisting of at least one needle board, a plurality of knitting needles supported in grooves in the needle board, a movable carriage oriented parallel above and to the needle board, the carriage being provided with a lock fitted with an electromagnetic needle selection component, said electromagnetic component being mounted on the lock by means of guiding means permitting free movement of said electromagnetic component in a direction substantially perpendicular to the plane of the needle board.

2. A machine according to claim 1, wherein the guiding means includes at least one guiding rod oriented perpendicular to the plane of the needle board and disposed laterally to the side of the electromagnetic component.

3. A machine according to claim 1, characterized in that the guiding means further includes means permitting pivotal movement about a pivot axis disposed parallel to the plane of the needle board and laterally to the side of the electromagnetic component.

4. A machine according to claim 3 additionally including a spring bearing on the electromagnetic needle selection component urging said component toward said needle board.

5. A machine according to claim 3, characterized in that the pivot axis is parallel to the plane of the needle board and parallel to the grooves of the needle board receiving the needles so that the needles can slide and said axis is located behind the electromagnetic component with respect to the direction of active movement of the component.

6. The invention of claim 2, characterized in that the guiding means further includes means permitting pivotal movement about a pivot axis disposed parallel to the plane of the needle board and laterally to the side of the electromagnetic component.

7. The invention of claim 6, additionally including a spring bearing on the electromagnetic needle selection component urging said component toward said needle board.

8. The invention of claim 7, characterized in that the pivot axis is parallel to the plane of the needle board and parallel to the grooves of the needle board receiving the needles so that the needles can slide and said axis is located behind the electromagnetic component with respect to the direction of active movement of the component.

* * * * *